United States Patent [19]

Asada

[11] Patent Number: 4,806,226

[45] Date of Patent: Feb. 21, 1989

[54] PROCESS FOR ELECTROLYTICALLY COLORING ALUMINUM MATERIAL

[75] Inventor: Tahei Asada, Tokyo, Japan

[73] Assignee: Corona Enterprises, Inc., Cerritos, Calif.

[21] Appl. No.: 23,494

[22] Filed: Mar. 9, 1987

[30] Foreign Application Priority Data

Dec. 17, 1984 [JP] Japan ..... 59-264494

[51] Int. Cl.[4] ..... C25D 11/22

[52] U.S. Cl. ..... 204/37.6; 204/42

[58] Field of Search ..... 204/37.6, 42, 58

[56] References Cited

U.S. PATENT DOCUMENTS 4,070,255 1/1978 Hasegawa ..... 204/42

4,659,439 4/1987 Watanabe et al. ..... 204/37.6

OTHER PUBLICATIONS

Abner Brenner, Electrodeposition of Alloys, vol. II, Academic Press, New York, 1963, pp. 194–205.

JIS H 8681 (1980).

*Primary Examiner*—John F. Niebling

*Assistant Examiner*—William T. Leader

*Attorney, Agent, or Firm*—Armstrong, Nikaido, Marmelstein & Kubovcik

[57] ABSTRACT

A process for electrolytically coloring an aluminum material wherein a base aluminum or aluminum alloy is anodized and the anodized material is electrolyzed in a second electrolytic coloring step using a bath containing nickel and zinc salts, a chelating reagent for nickel ions and a supporting electrolyte at a pH of 4.5 or greater using alternating, direct or dual alternating-direct current electrolytic processes. A molybdate may also be employed in the secondary electrolysis process and the resultant coating has a color ranging from a grey series to black.

27 Claims, No Drawings

PROCESS FOR ELECTROLYTICALLY COLORING ALUMINUM MATERIAL

BACKGROUND OF THE INVENTION

1. Field of the Invention

This invention relates to a process for producing a corrosion resistant colored surface on an aluminum or aluminum alloy substrate.

2. Description of the Prior Art

Anodized aluminum, formed by the electrolytic treatment of aluminum or aluminum alloys in a sulfuric acid bath may be treated by a secondry electrolytic treatment in a coloring bath containing metallic salts, as is described in U.S. Pat. No. 3,382,160. It is believed that this process results in the precipitation of the metal salts in the pores of the anodic coating on the aluminum substrate. Aluminum treated by this process produces colored materials useful for construction and other applications, but the color series which may be obtained is limited to a bronze series merging into black.

The codeposition of nickel and zinc from a plating bath containing nickel sulfate and zinc sulfate, at a pH of 2–4, onto has been reported by K. Mitsuo et al, *Electrochemistry* 45, No. 12 (1977), pp. 728–733 and *Electrochemistry* 47, No. 2 (1979) pp. 89–94. According to these papers, the plated coating of an intermetallic compound of nickel and zinc are formed on a rolled thin copper plate. The color of the plated coating disclosed therein has a silver-white tint and it has not been found possible heretofore, using such a plating process, to obtain a pure grey series coating.

There remains a long-felt need to prepare secondarily colored anodized aluminum products of a true grey series, without bronze tint and with enhanced corrosion resistance.

SUMMARY OF THE INVENTION

Applicants have discovered that it is possible to prepare a grey series secondary electrolytic coating on anodized aluminum by preparing an electrolytic coloring bath containing mixtures of nickel and zinc salts as a coloring agent, by the addition thereto of a chelating agent for nickel ions, by adjustment of the pH of the bath by selection of a suitable supporting electrolyte in the bath and by the application of an electric current. The color coated aluminum materials according to this invention provide a grey series to black coating which also has superior corrosion resistance to the secondary electrolytically coated products of the prior art.

According to applicant's process, aluminum or an aluminum alloy (hereinafter "aluminum material") is first anodized to form an anodized aluminum material and the anodized aluminum material is treated secondarily, using alternating or direct currents, or dual currents of both alternating and direct current, in a coloring bath having a pH of 4.5 or greater, containing the coloring agent, chelating agent and supporting electrolyte. The coloring agent may be further modified by the addition of a molybdate salt.

A "chelating agent" for nickel ions may be any chemical compound that acts to stabilize nickel ions so that the rate of deposition of nickel ions during the secondary electrolytic coloring process is controlled to effect the codeposition of zinc and nickel during the treating process in ratios of nickel to zinc which produce a grey color.

DETAILED DESCRIPTION OF THE INVENTION

The anodic treatment of aluminum materials in electrolytes, typically acids, produces an oxide film of substantial thickness and abrasion resistance. The oxide coating is integral with the aluminum and adheres tightly to the base substrate. The coating is an amorphous material having minute pores. Secondary treatement of the coating is usually an electrolytically coloring process.

When the secondary treatment is the electrolytic coloring process, such as that described in U.S. Pat. No. 3,382,160 reference, a coating of superior corrosion resistance is obtained but can be varied in the darkness of the coating but which contains an unavoidable bronze tint to the point where the color merges to black.

According to the process of this invention, a secondary electrolytic treatment is performed using an electrolytic coloring bath containing a combination of nickel and zinc salts, preferably in a specific weight ratio based upon the content of nickel and zinc, a chelating reagent for nickel ions and a suitable supporting electrolyte.

The coloring agent which is used contans nickel salts, preferably nickel sulfate, ammonium nickel sulfate or nickel sulfamate. Zinc salts, preferably zinc sulfate or zinc chloride are also required in the coloring bath.

The chelating reagent for nickel ions is any chemical compound which acts to stabilize nickel ions so that the rate of deposition of the nickel ions may be controlled during the deposition of zinc ions. Preferred chelating agents are gluconic acid, malonic acid, sulfosalicylic acid, tartaric acid, citric acid, sulfophthalic acid, sulfamic acid, and boric acid.

A supporting electrolyte is also required in the bath. Preferred supporting electrolytes are ammonium sulfate, magnesium sulfate and other sulfates which do not affect the nickel to zinc ratio.

The pH of the bath is at least 4.5 and is preferably within the range of 5 to 9.

In addition to the above, it has been found that the addition of a molybdate salt, such as ammonium molybdate, is advantageous in producing a grey series coloration.

In the secondary electrolytic treatment, a direct current or an alternating current may be used and it is also possible to use dual currents of both alternating and direct current. Voltage differences of 10 to 30 volts are preferred at a bath temperature of 15° to 30° C. The anodized aluminum material is used as one electrode during the secondary electrolytic treatment. The other electrode may be any electrode which does not produce contaminating ions, and is preferably nickel or carbon.

Although not wishing to be bound by any particular theory, applicant hypothesizes that the following principles serve to explain the operation of applicant's invention.

Aluminum has a strong negative polarity in electrolytic treatment. As a result, the positive ions of metals in the treatment bath are strongly attracted to the aluminum and form a concentration gradient throughout the bath, analogous to the conditions observed during plating operations.

Mitsuo et al. reported, in the articles cited above, that codeposition of nickel and zinc occurred during plating from a bath containing nickel sulfate and zinc sulfate at a pH between 2 and 4, and they hypothesized that intermetallic compounds of nickel and zinc, particularly $NiZn_3$ and $Ni_5Zn_{21}$ were deposited and were responsible for the observed color.

In the study of the process of this invention, applicant has found that, even when the concentration of a nickel salt was four times the concentration of a zinc salt (i.e., concentration ratios of 1:0.25) at a pH of 6.5, chemical analysis of the deposited metals showed an atomic ratio of approximately 1:1 when an alternating current of 14 volts for 3 minutes was used. The resultant color was grey, and it was concluded that the deposition of zinc occurs much faster than the deposition of nickel. The degree of coloration (darkness of color) can be increased by continuation of the AC electrolysis. Further adjustment of the deposition conditions can increase the deposition rate of zinc and also increase the dispersability of the nickel salt. This is accomplished by selection of the appropriate chelating agent and the concentration thereof.

The colored aluminum material obtained by this invention has superior corrosion resistance than the colored aluminum material obtained by the prior art nickel salt electrolytic bath. This is believed to be due, at least in part, to the apparent fact that the chelating agent for nickel ions in the bath causes the zinc to deposit preferentially on the anodic coating of the aluminum and, therefore, to improve the corrosion resistance.

Using the CASS anticorrosion test according to Japanese Industrial Standard-H 8681 on the colored aluminum product of this invention and on the colored aluminum product obtained by the conventional nickel salt electrolytic bath, applicant obtained the results reported in Table 1 at 8, 16, 24 and 32 hours, using a sample with a 9 μm coating thickness and a secondary electrolytic treatment process conducted at 15 volts AC for 3 minutes

TABLE 1

| CASS test time | This invention bath | Conventional bath |
|---|---|---|
| 8 hours | R.N. 10 | R.N. 10 |
| 16 hours | R.N. 10 | R.N. 10 |
| 24 hours | R.N. 10 | R.N. 9.8 |
| 32 hours | R.N. 10 | R.N. 9.5 |

R.N. designates the rating number related to rate of total corroded area under JIS H 8681-1980.

As seen from the results of Table 1, the colored aluminum material obtained by the practice of this invention has a R.N. of 10 over the entire testing time period of 32 hours. In contrast, the product of the conventional process deteriorates to a R.N. of 9.8 after 24 hours and to an R.N. of 9.5 at the conclusion of 32 hours.

The colored aluminum is subjected to a sealing treatment in hot water.

EXAMPLE 1

A sheet of 2S aluminum material was anodized in a sulfuric acid bath containing 15% by weight sulfuric acid at room temperature for 30 to 50 minutes, using a direct current. The resulting anodic coating of 10 μm thickness was obtained. The anodized aluminum material was placed in an electrolytic coloring bath containing 30 g/l of boric acid, 20 g/l of nickel sulfate, 6 g/l of zinc sulfate, 25 g/l of magnesium sulfate and 40 g/l of ammonium sulfate, at a pH of 6.5. With a nickel plate as the other electrode an AC voltage of 17 V was applied for 2 minutes and produced a light grey colored aluminum material finish. At a duration of 4 minutes, a slightly blue-green grey coating was present. When the same piece was electrolyzed at 15 V for 12 minutes, an essentially black surface was obtained.

EXAMPLE 2

A 43S aluminum material was anodized in a sulfuric acid bath to obtain an anodic coating of 15 μm in thickness. Using carbon as the other electrode, the anodized aluminum material was treated in an electrolytic coloring bath containing 20 g/l of sulfamic acid, 25 g/l of nickel sulfamate, 5 g/l of zinc chloride, 0.5 g/l of ammonium molybdate, 25 g/l of magnesium sulfate and 30 g/l of ammonium sulfate at a pH of 7.3 and electrolyzed using an AC current of 17 V for 30 seconds to obtain a light grey colored aluminum material finish. A darker grey is obtained if the treatment is continued for one minute, and a deep grey colored material finish is obtained at the same voltage when treated for 3 minutes. When the voltage is adjusted to 14 volts, a black material may be obtained after 13 minutes of treatment under the same conditions.

EXAMPLE 3

An A 1,100 P-H 24 aluminum material was anodized in a sulfuric acid bath to form an anodic coating of 10 μm in thickness. The anodized aluminum was treated in a coloring electrolytic bath containing 20 g/l of sulfosalicylic acid, 20 g/l of nickel sulfate, 4 g/l of zinc sulfate, 25 g/l of magnesium sulfate and 40 g/l of ammonium sulfate at a pH of 7.8. With a nickel electrode used as the other electrode an alternating current at a voltage of 15 V was applied for one minute, and a light grey colored material was obtained. Continuation for an additional minute produced a standard grey colored sample. At a total time of 3 minutes, a slightly blue-green deep grey coating was obtained, and, at the same voltage, treatment of for 12 minutes produced a black finish.

EXAMPLE 4

An A 6,063S-T5 aluminum material was used and anodized in a sulfuric acid bath to form an anodic coating of 15 μm in thickness. The anodized aluminum was treated in a secondary electrolytic coloring bath containing 15 g/l of sulfophthalic acid, 30 g/l of nickel sulfate, 6 g/l of zinc sulfate, 30 g/l of magnesium sulfate and 25 g/l of ammonium sulfate at a pH of 5.3. Using nickel as the other element, an alternating current was applied at 18 V for 2 minutes and produced a grey aluminum material finish. A black finish was obtained after 10 minutes under the same conditions.

EXAMPLE 5

Using the same aluminum material and secondary electrolytic coloring bath as in Example 4, an anodized aluminum material was treated using a DC voltage of 10 V for 40 seconds to obtain a colored aluminum material finish having a slightly blue-green tinged grey finish.

EXAMPLE 6

A 2S aluminum material was anodized in a sulfuric acid bath to form an anodic coating of about 14 μm in thickness. Using carbon as the other electrode, the anodized material was treated in a secondary electrolytic coloring bath containing 30 g/l of gluconic acid, 25 g/l of nickel sulfate, 15 g/l of ammonium sulfate, 25 g/l of magnesium sulfate and 5 g/l of zinc sulfate at a pH of 7.5 and both AC and DC currents were applied. When treated at 10 V for 2 minutes, a blue-green tinged grey colored aluminum material finish was obtained. A medium grey material finish was obtained at 12 V after 2 minutes. A black colored finish was obtained at 14 V after treatment for 7 minutes.

It is readily apparent that the above-described process for the treatment of aluminum material to obtain a grey series, corrosion resistant finish meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

I claim:

1. A process for electrolytically coloring an aluminum material substrate comprising:

(a) anodizing an aluminum material substrate;

(b) introducing said anodized aluminum material into a bath comprising a nickel salt, a zinc salt, a chelating reagent for nickel ions and magnesium sulfate, at a pH of 4.5 or greater, and in which the compounding ratio of nickel salt to zinc salt is 1:0.1 to 0.5; and (c) electrolyzing said substrate.

2. A process for electrolytically coloring an aluminum material substrate comprising:

(a) anodizing an aluminum material substrate;

(b) introducing said anodized aluminum material into a bath comprising a nickel salt, a zinc salt, a molybdate salt, a chelating reagent for nickel ions and magnesium sulfate, at a pH of 4.5 or greater, and in which the compounding ratio of nickel salt to zinc salt is 1:0.1 to 0.5; and (c) electrolyzing said substrate.

3. A process for electrolytically coloring an aluminum material substrate according to claim 1, wherein said nickel salt is selected from the group consisting of nickel sulfate, ammonium nickel sulfate and nickel sulfamate.

4. A process for electrolytically coloring an aluminum material substrate according to claim 2, wherein said nickel salt is selected from the group consisting of nickel sulfate, ammonium nickel sulfate and nickel sulfamate.

5. A process for electrolytically coloring an aluminum material substrate according to claim 1, wherein said zinc salt is selected from the group consisting of zinc sulfate and zinc chloride.

6. A process for electrolytically coloring an aluminum material substrate according to claim 2, wherein said zinc salt is selected from the group consisting of zinc sulfate and zinc chloride.

7. A process for electrolytically coloring an aluminum material substrate according to claim 2, wherein the molibdate salt is ammonium molybdate.

8. A process for electrolytically coloring an aluminum material substrate according to claim 1, wherein said chelating reagent for nickel ions is at least one selected from the group consisting of gluconic acid, malonic acid, sulfosalicylic acid, tartaric acid, citric acid, sulfophthalic acid, sulfamic acid, and boric acid.

9. A process for electrolytically coloring an aluminum material substrate according to claim 2, wherein said chelating reagent for nickel ions is at least one selected from the group consisting of gluconic acid, malonic acid, sulfosalicylic acid, tartaric acid, citric acid, sulfophthalic acid, sulfamic acid, and boric acid.

10. A process for electrolytically coloring an aluminum material substrate according to claim 1, wherein said electrolysis process according to step (C) is performed using alternating current.

11. A process for electrolytically coloring an aluminum material substrate according to claim 2, wherein said electrolysis process according to step (C) is performed using alternating current.

12. A process for electrolytically coloring an aluminum material substrate according to claim 1, wherein said electrolysis process according to step (C) is performed using direct current.

13. A process for electrolytically coloring an aluminum material substrate according to claim 2, wherein said electrolysis process according to step (C) is performed using direct current.

14. A process for electrolytically coloring an aluminum material substrate according to claim 1, wherein said electrolysis process according to step (C) is performed using dual current of alternating and direct current.

15. A process for electrolytically coloring an aluminum material substrate according to claim 2, wherein said electrolysis process according to step (C) is performed using dual current of alternating and direct current.

16. A process for electrolytically coloring an aluminum material substrate according to claim 1, wherein the colored coating produced has a color ranging from a grey series to black.

17. A process for electrolytically coloring an aluminum material substrate according to claim 2, wherein the colored coating produced has a color ranging from a grey series to black.

18. A process for electrolytically coloring an aluminum material substrate according to claim 1, wherein the second electrode in the second electrolysis step is selected from the group consisting of carbon and nickel.

19. A process for electrolytically coloring an aluminum material substrate according to claim 2, wherein the second electrode in the second electrolysis step is selected from the group consisting of carbon and nickel.

20. A process for electrolytically coloring an aluminum material substrate according to claim 1, wherein the pH of the bath is within the range of 7.3 to 7.8.

21. A process for electrolytically coloring an aluminum material substrate according to claim 1, wherein the pH of the bath is 7.3.

22. A process for electrolytically coloring an aluminum material substrate according to claim 1, wherein the pH of the bath is 7.5.

23. A process for electrolytically coloring an aluminum material substrate according to claim 1, wherein the pH of the bath is 7.8.

24. A process for electrolytically coloring an aluminum material substrate according to claim 2, wherein the pH of the bath is within the range of 7.3 to 7.8.

25. A process for electrolytically coloring an aluminum material substrate according to claim 2, wherein the pH of the bath is 7.3.

26. A process for electrolytically coloring an aluminum material substrate according to claim 2, wherein the pH of the bath is 7.5.

27. A process for electrolytically coloring an aluminum material substrate according to claim 2, wherein the pH of the bath is 7.8.

* * * * *